US005924887A

United States Patent [19]

Aoyama et al.

[11] Patent Number: 5,924,887

[45] Date of Patent: Jul. 20, 1999

[54] PRESSURE CONTACT TERMINAL FITTING

[75] Inventors: Masahiko Aoyama; Hitoshi Okumura; Mitsugu Furutani; Keigo Atsumi, all of Yokkaichi, Japan

[73] Assignee: Sumitomo Wiring Systems, Ltd., Japan

[21] Appl. No.: 08/982,638

[22] Filed: Dec. 2, 1997

[30] Foreign Application Priority Data

Dec. 2, 1996 [JP] Japan ..... 8-321875

[51] Int. Cl.[6] ..... H01R 4/26

[52] U.S. Cl. ..... 439/400

[58] Field of Search ..... 439/397, 395, 439/407, 406, 400, 417

[56] References Cited

U.S. PATENT DOCUMENTS

| | | | |
|---|---|---|---|
| 3,812,449 | 5/1974 | Elm . | |
| 4,385,794 | 5/1983 | Lucius | 439/397 |
| 4,894,020 | 1/1990 | Holden et al. | 439/191 |
| 5,112,244 | 5/1992 | Kuzuno et al. | 439/395 |
| 5,133,672 | 7/1992 | Nelligan, Jr. et al. | 439/399 |
| 5,139,434 | 8/1992 | Goodman | 439/399 |
| 5,399,097 | 3/1995 | Sakaie et al. | 439/395 |
| 5,588,868 | 12/1996 | Tsuji et al. | 439/397 |
| 5,591,044 | 1/1997 | Abe et al. | 439/397 |

*Primary Examiner*—Gary Paumen
*Assistant Examiner*—Briggitte R. Hammond
*Attorney, Agent, or Firm*—Banner Witcoff, Ltd.

[57] ABSTRACT

A pressure contact terminal (10) has a pair of anterior and posterior pressure contact blades (17) formed thereon to define pressure contact grooves (20). A pushing-in member (23) is provided that fits into the terminal and has pressure contact grooves (27) formed on anterior and posterior end faces. The upper ends of the pressure contact grooves (27) have pressing-down members (28) for pressing down an electric wire (1) to a specified extent. After placing an end of the electric wire (1) on the pressure contact blades (17), the pushing-in member (23) is placed thereon and clamped using pliers P. Locking protrusions (31) enter locking holes (32) to retain the pushing-in member (23).

14 Claims, 9 Drawing Sheets

PRESSURE CONTACT TERMINAL FITTING

TECHNICAL FIELD

The present invention relates to a pressure contact terminal fitting.

BACKGROUND TO THE INVENTION

A pressure-contact electrical terminal fitting has pressure contact blades defining one or more pressure contact grooves, an electric wire being inserted into the pressure contact grooves in use, thereby causing the edges of the blades to cut through the covering of the wire and to make contact with the core, resulting in an electrical connection being established between the wire and the fitting. It is common for such a pressure contact operation to be carried out simultaneously for a plurality of wires and fittings, using a special jig or an automatic machine.

However, it is conceivable that during maintenance or inspection, etc., a defect may be discovered in a particular pressure contact; in that case only that wire needs to be changed. However, since a jig or an automatic machine for effecting pressure contact is not necessarily available at the maintenance site, the problem cannot be easily resolved.

The pressure contact terminal fitting of the present invention has been developed after taking the above problem into consideration, and aims to permit the use of a readily available tool for establishing a pressure contact connection.

SUMMARY OF THE INVENTION

According to the invention there is provided a pressure contact terminal fitting comprising a body portion having opposed pressure contact blades to engage an electrical wire, and a pushing-in member for engaging an electrical wire and pushing said wire into engagement with said blades.

Such a separate pushing-in member may be engaged by pliers acting on the body portion, and this permits replacement of a wire using a readily available tool. Furthermore the pushing-in member protects the wire from direct engagement with the pliers, and this ensures electrical engagement of the wire in a smooth pre-defined manner without incidental wire damage.

The pushing-in member may be of electrically conductive material, and have pressure contact blades to electrically engage the wire. Latching means may be provided between the pushing-in member and the body portion. Position setting means may be provided to determine the depth of engagement of the wire, for example by abutment of the body portion and pushing-in member or by engagement of latching means.

In a preferred embodiment the pushing-in member and body portion are both of open box form, one of the body portion and pushing-in member fitting tightly within the other.

Preferably the pushing-in member is folded from a sheet metal blank, but it may alternatively be formed from a moulded plastic material.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENTS

Figure 1:
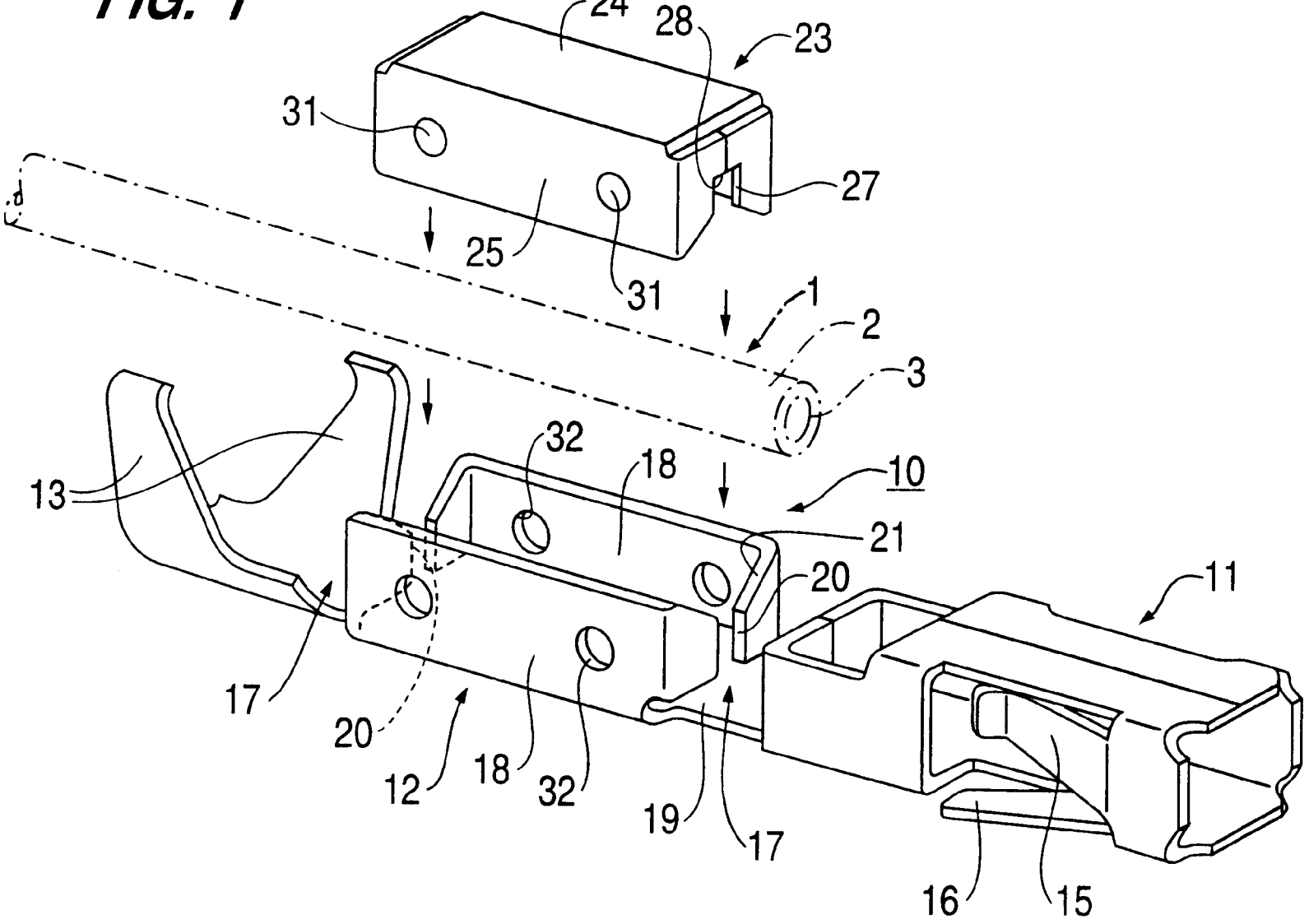
FIG. 1 is a diagonal view of a first embodiment of the present invention showing a state prior to the pressure contact of the terminal fitting.

A first embodiment of the present invention is described, with reference to FIGS. 1 to 7. This embodiment is an example of the application of the invention to a female pressure contact terminal fitting. As shown in FIG. 1, the terminal fitting of this embodiment comprises a terminal main body 10 and a pushing-in member 23.

The terminal main body 10 is formed by cutting and bending in sequence an electrically conductive metal plate. It comprises, from front to rear, a connecting member 11 for connection to a tab member of a corresponding male terminal fitting (not shown), a pressure contact member 12, that makes pressure contact with an end of an electric wire 1, and barrels 13 that are crimped to the rear end of the pressure contact portion of the electric wire 1.

The anteriorly located pressure contact member 11 is schematically angularly tubular in shape. A resilient contact member 15 is formed within the pressure contact member 11 by being cut out from a side face, the resilient contact member 15 making elastic contact with a tab member of a male terminal fitting. A lance 16 is part-sheared from a base face and when the terminal fitting is inserted into a cavity of a connector housing (not shown), the lance 16 is retained unremovably by a stopping member located within the cavity. The pair of barrels 13 are mutually displaced in an anterior-posterior direction.

The pressure contact member 12 is channel shaped with its upper face open so as to allow the electric wire 1 to be inserted therein. The front and rear ends have a pair of pressure contact blades 17 formed thereon. Specifically, left and right side walls 18 rise up at a right angle from side edges of a base plate 19, and the anterior and posterior ends of the side plates 18 are bent so as to face each other by protruding inwards, thereby forming pairs of anterior and posterior pressure contact blades 17, pressure contact grooves 20 being formed between the mutually facing edges. The width of the pressure contact grooves 20 is set to a specified dimension so as to be slightly smaller than the diameter of the core of the wire 1, the upper end of the pressure contact grooves 20 having guiding faces 21 that narrow towards the grooves 20.

The pushing-in member 23 is press formed from electrically conductive sheet metal. It has a box-shape with a lower face open so as to fit into the pressure contact member 12. This pushing-in member 23 is inserted until it makes contact with the base plate 19, its roof plate 24 being in the same plane as the upper edge of the pressure contact member 12, or protruding slightly (see FIG. 5). As described later, this is done in order to ensure that a clamping operation can be carried out using a pair of pliers P.

Figure 2:
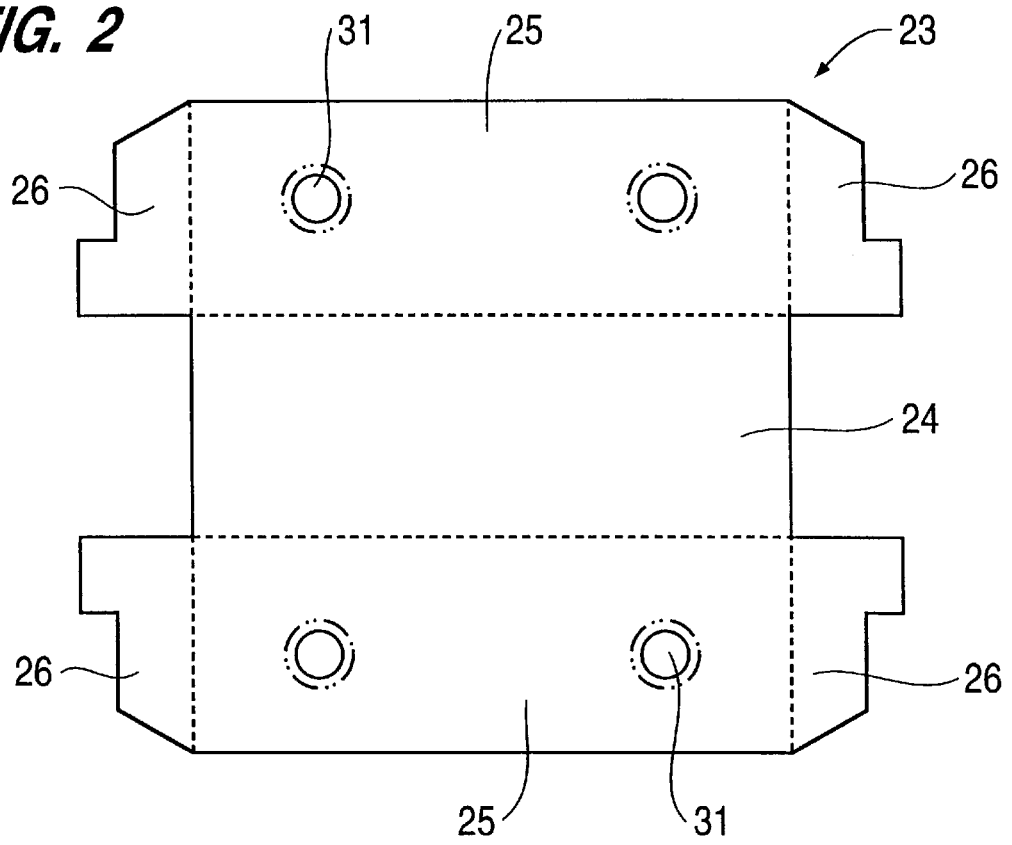
FIG. 2 is an expanded view of a pushing-in member of the first embodiment.
Figure 3:
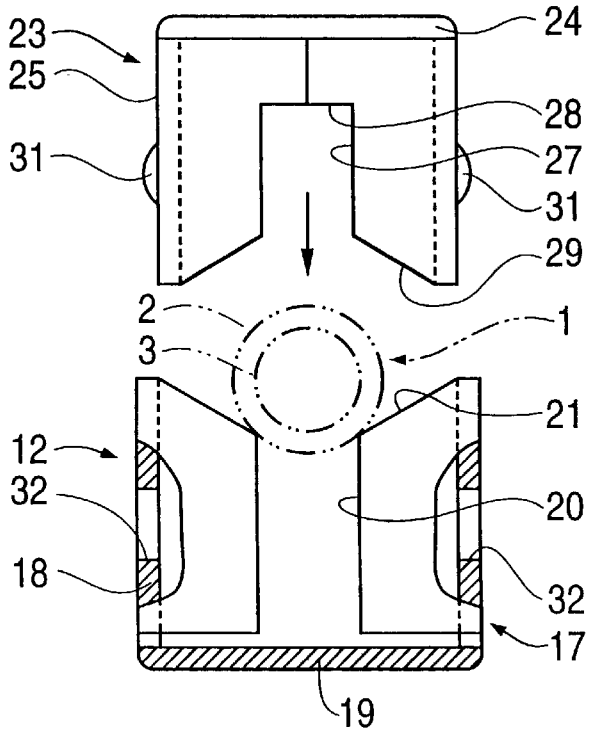
FIG. 3 is a cross-sectional view showing a state prior to pressure contact.

In particular, and as illustrated by the developed plan in FIG. 2, left and right side plates 25 are formed by being bent at a right angle from side edges of the roof plate 24. Further, end-face plates 26 are formed on the anterior and posterior ends of the side plates 25, and are bent inwards at a right angle so as to face each other. As shown in FIG. 3, a pressure contact groove 27 is formed between the ends of the face plates 26, this groove 27 making pressure contact with the electric wire 1. The width of the groove 27 is the same as that of the pressure contact groove 20. The upper end of the pressure contact groove 27 is closed, and this closed end constitutes a pressing-down member 28 that serves to push in the electric wire 1. The height of the pressing-down member 28 is set so that the electric wire 1 is pressed down to a specified position when the pushing-in member 23 is completely inserted, as described earlier. The lower end of the pressure contact groove 27 has guiding members 29 that widen in the direction of opening of the pressure contact member 12.

The left and right side plates 25 of the pushing-in member 23 have an anteriorly and posteriorly located pair of pressed locking protrusions 31 formed into a spherical shape. Corresponding to these, the left and right side plates 18 have a pair each of anteriorly and posteriorly locates spherical locking holes 32, the locking protrusions 31 fitting therewith.

Figure 4:
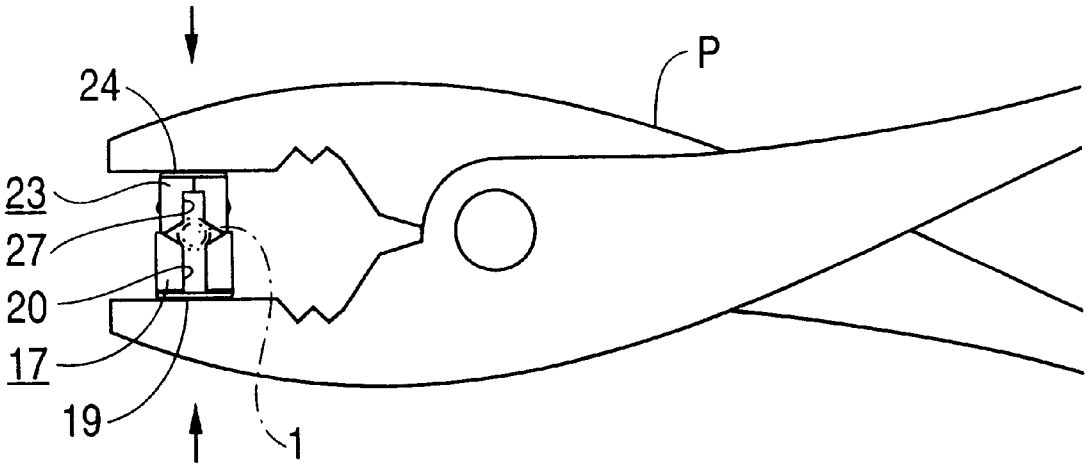
FIG. 4 is a side view showing the pressure contact operation.

Operation of the first embodiment is as follows. When the pressure contact operation is carried out, as shown in FIG. 3, the electric wire 1 is mounted so as to sit on the guiding members 21 of the blades 17. Next, as shown by the arrow in FIG. 3, the pushing-in member 23 is pushed down so as to clamp the electric wire 1, and, as shown in FIG. 4, the base plate 19 and the roof face 24 are squeezed together by means of the pliers P.

Figure 5:
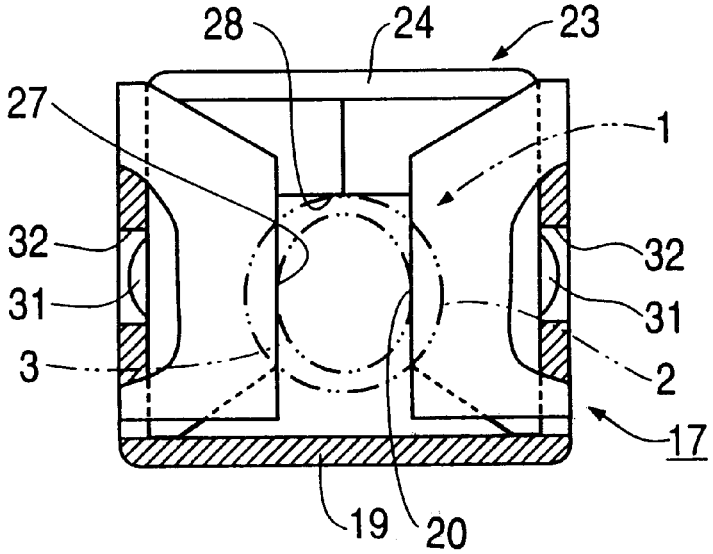
FIG. 5 is a cross-sectional view showing a completed pressure contact state.
Figure 6:
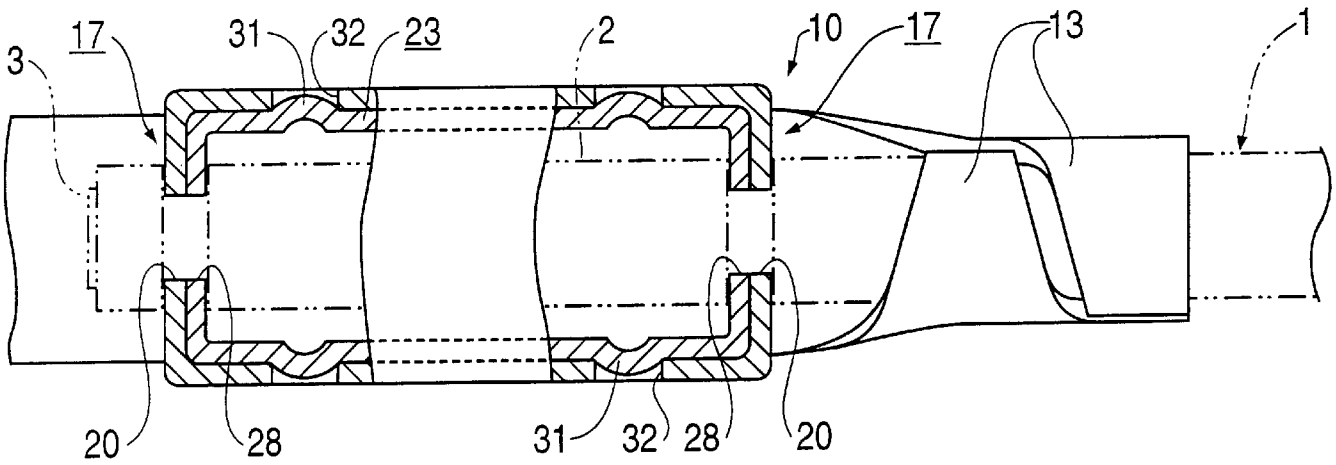
FIG. 6 is a partially cut-away plane view.

When this is done, the electric wire 1 is pressed into both the pressure contact groove 27, and into the pressure contact groove 20. The edges of the grooves 20 and 27 cut into a covering 2 of the electric 1, and thereby make contact with the core 3. Finally, as shown in FIG. 5, the electric wire 1 is pressed down by the pressing-down member 28 to the approximate centre of the pressure contact groove 20.

In this manner, the electric wire 1 and the terminal main body 10 make electrical contact both at the anterior and posterior pressure contact blades 17 and the pushing-in member 23. Simultaneously, the locking protrusion 31 fits with the corresponding locking hole 32, resulting in the pushing-in member 23 being retained.

Figure 7:
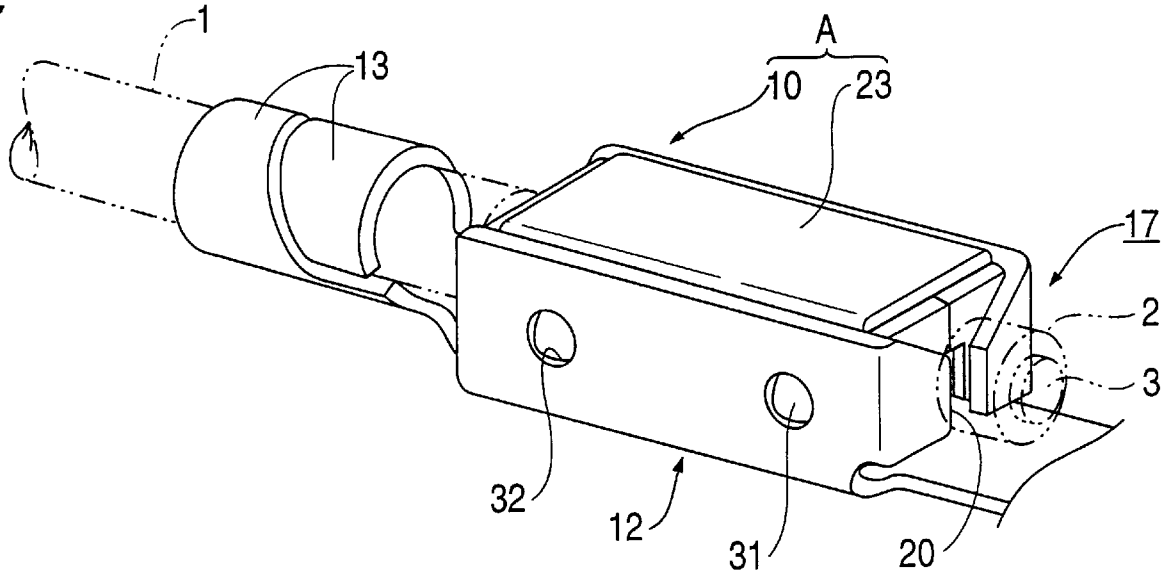
FIG. 7 is a diagonal view of a pressure contact electric wire.

Finally, the pair of barrels 13 provided towards the posterior of the pressure contact member 12 are crimped, and as shown in FIG. 7, the pressure contact terminal fitting A is formed.

As described above, according to the first embodiment, even without a specialized automatic tool it is possible to fix a pressure contact fitting easily, using a pair of pliers P. Further, the pushing-in member 23 is locked in a unified manner with the pressure contact member 12. Accordingly, in the case where the pressure contact electric wire is handled, the electric wire 1 is less likely to separate from the pressure contact member 12. Furthermore the strength of the pressure contact member 12 is increased, thereby preventing change in shape, etc. The tensile strength of the connection also improves. Moreover, since the pushing-in member 23 also has the pressure contact groove 27 provided therein, there are four more points making pressure contact, thereby greatly increasing the reliability of the electrical connection.

Although in the first embodiment a pressure contact groove 27 is also provided in the pushing-in member 23, it may equally be arranged that the pushing-in member 23 serves to merely push in the electric wire 1. In such a case, a cut-away groove may be provided at the location where the pressure contact groove 27 would have been, this cut-away groove clamping the electric wire 1 and allowing it to pass therein.

In the second to fourth embodiments, changes have been introduced in the pushing-in member. The same numbers are accorded to parts having the same configuration as in the first embodiment, and an explanation thereof omitted.

Figure 8:
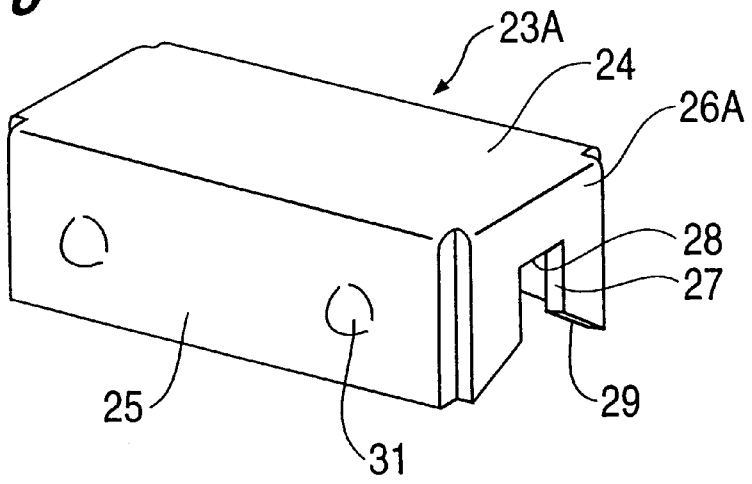
FIG. 8 is a diagonal view of a pushing-in member of a second embodiment of the present invention.
Figure 9:
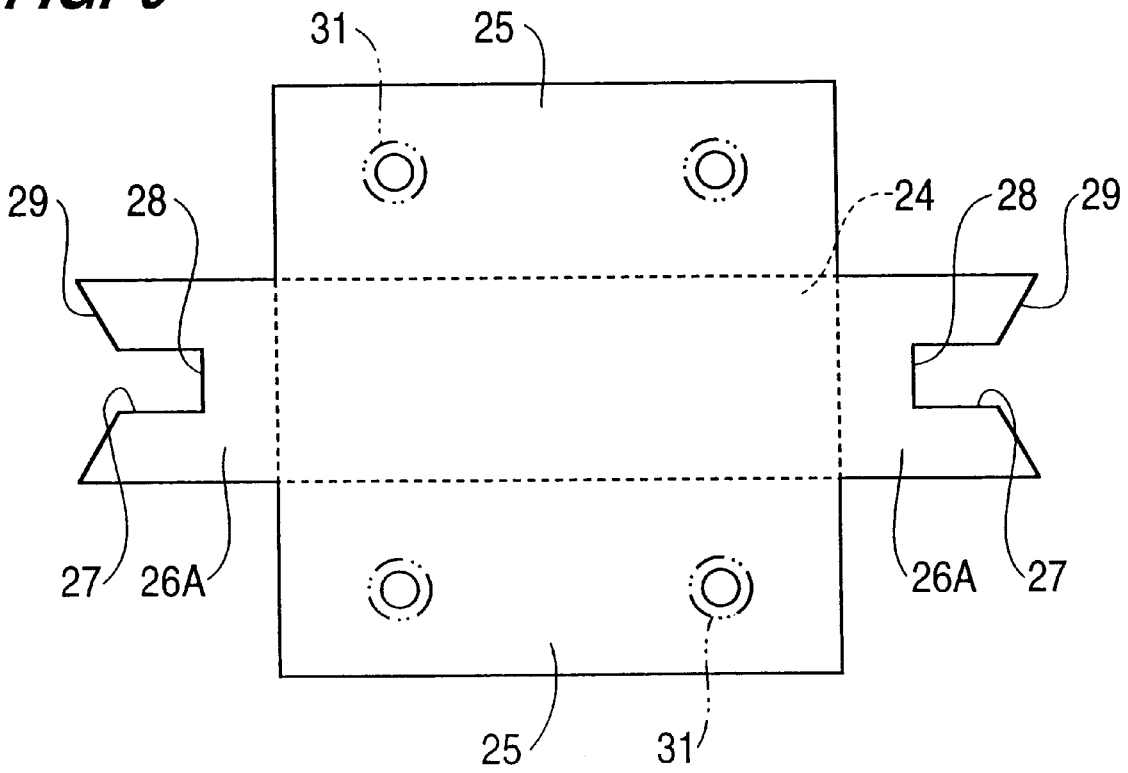
FIG. 9 is an expanded view of the pushing-in member of the second embodiment.

The second embodiment is explained with the aid of FIG. 8 and FIG. 9. As shown in the developed shape in FIG. 9, the pushing-in member 23A of the second embodiment has side plates 25 formed on left and right side edges of a roof plate 24. Further, two end face plates 26A are formed on the anterior and posterior edges of the roof plate 24, these end face plates 26A having pressure contact grooves 27 pre-formed thereon for an electric wire 1. Then, as shown in FIG. 8, by bending the shape shown in FIG. 9 along the broken lines, the pushing-in member 23A is formed into a box shape with an open lower face. The pushing-in member 23A thus formed fits inside the pressure contact member 12 as described above.

Figure 10:
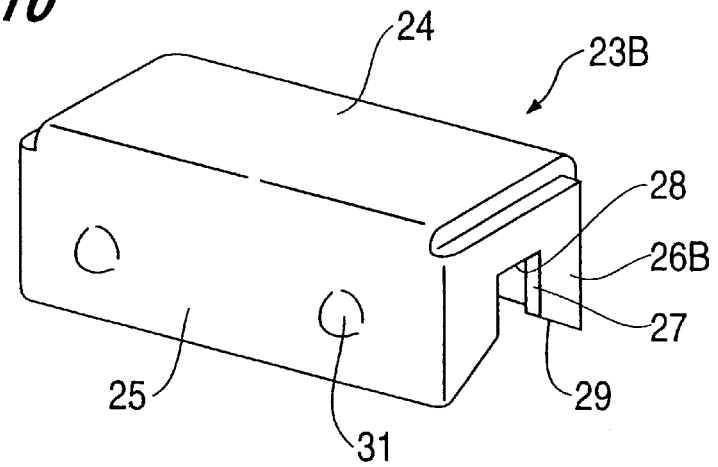
FIG. 10 is a diagonal view of a pushing-in member of a third embodiment of the present invention.
Figure 11:
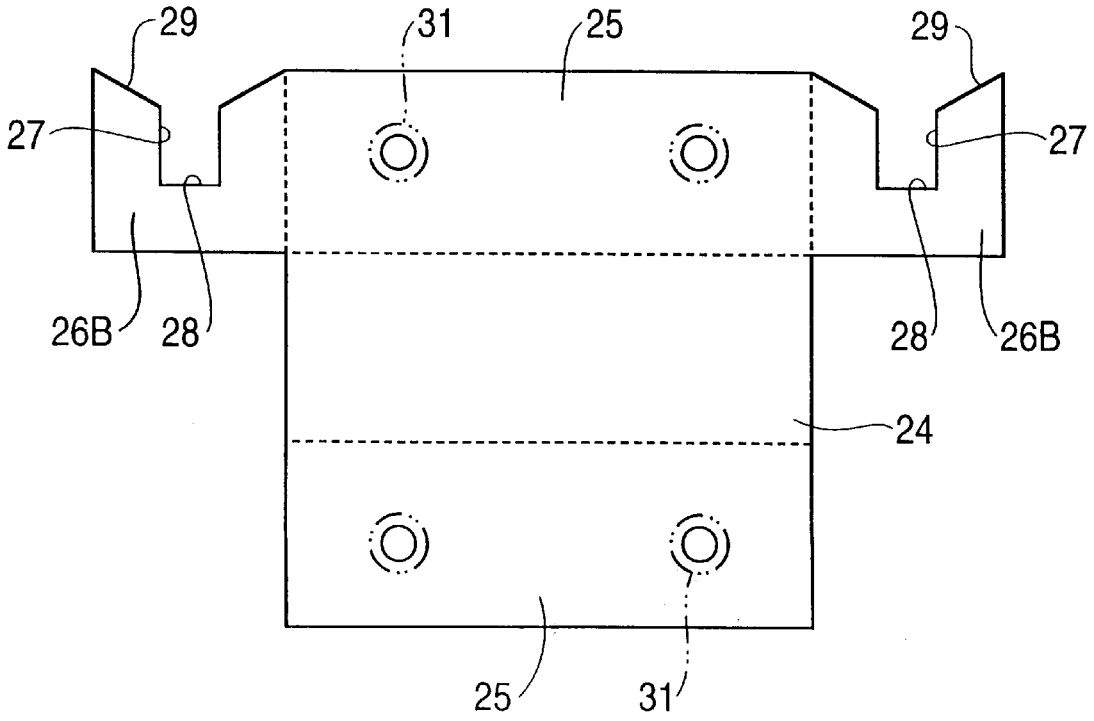
FIG. 11 is an expanded view of the pushing-in member of the third embodiment.

FIGS. 10 and 11 show a third embodiment of the present invention. As shown in the developed shape in FIG. 11, a pushing-in member 23B has side plates 25 formed in a connected manner on left and right side edges of a roof plate 24, and the anterior and posterior side edges of one of the sides plates 25 have end face plates 26B connected thereto, the end face plates 26B having pressure contact grooves 27 pre-formed thereon for an electric wire 1. By bending the extended shape shown in FIG. 11 at a right angle along each broken line shown in the diagram, the pushing-in member 23B is formed into a box shape with an open lower face. The pushing-in member 23B thus formed fits inside the pressure contact member 12.

Figure 12:
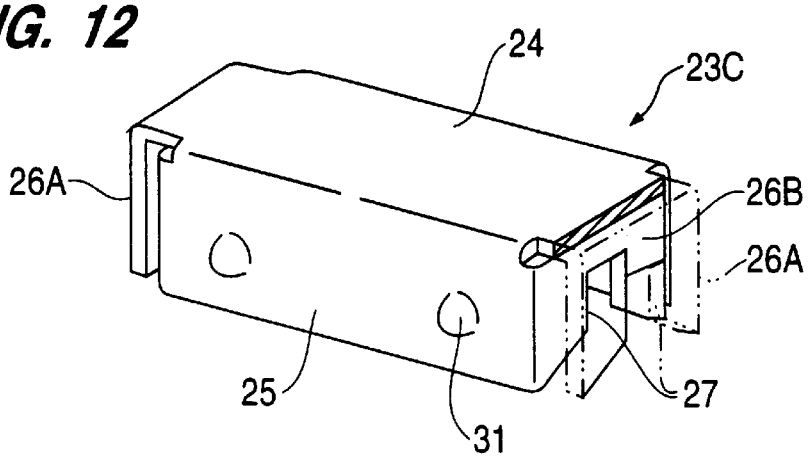
FIG. 12 is a diagonal view of a pushing-in member of a fourth embodiment of the present invention.
Figure 13:
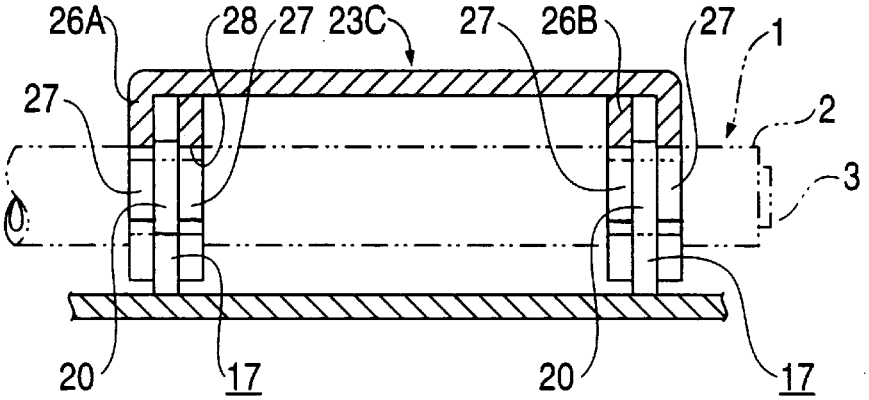
FIG. 13 is a cross-sectional view of the fourth embodiment showing the pushing-in member inserted into the pressure contact member.
Figure 14:
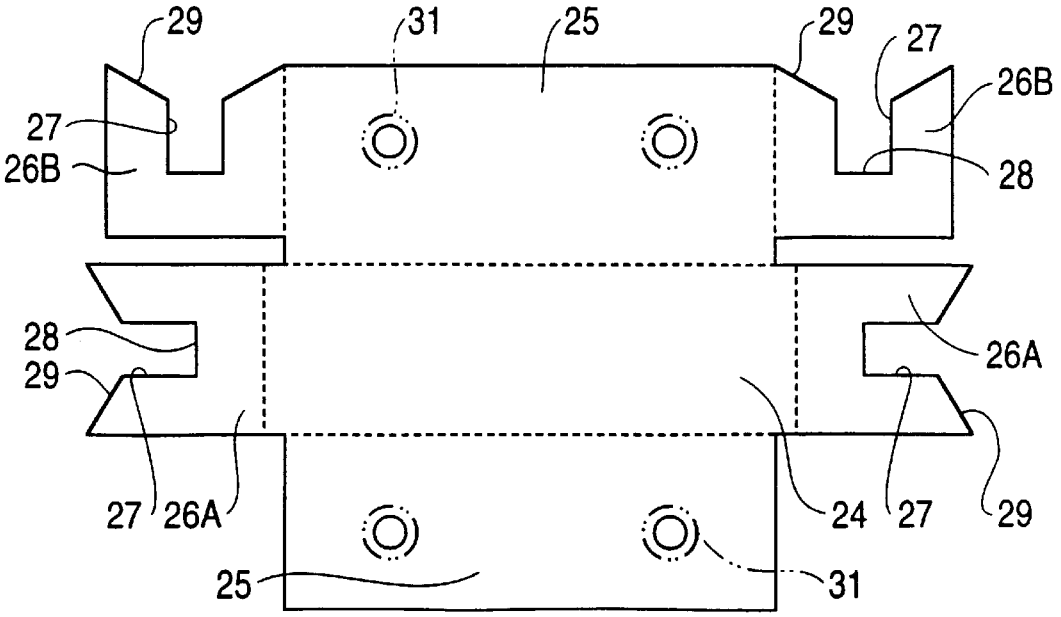
FIG. 14 is an expanded view of the pushing-in member of the fourth embodiment.

FIGS. 12 to 14 show a fourth embodiment of the present invention. A pushing-in member 23C is a combination of the shape of the second and third embodiments. In other words, side plates 25 are connected to the left and right side edges of a roof plate 24, and the front and rear ends of one of the side plates 25 have inner side end face plates 26B connected thereto, these having pressure contact grooves 27 pre-formed thereon for the electric wire 1. Further, the anterior and posterior ends of the roof face 24 similarly have outer side end face plates 26A connected thereto, these having pressure contact grooves 27 pre-formed thereon for the electric wire 1. The box shaped pushing-in member 23*c* having an open lower face shown in FIG. 12 is formed by effecting bending at a right angle along the broken lines shown in the diagram. When the pushing-in member 23C of the fourth embodiment is inserted into the pressure contact member 12 of the terminal main body 10, as shown in FIG. 13, the outer and inner side end face plates 26A and 26B respectively clamp the anterior and posterior faces of the pressure contact blades 17.

It is also possible to have the pressure contact groove portions in the pushing-in members 23A to 23C of the second to fourth embodiments function respectively as slideways for the electric wire 1, thereby limiting their function to pressing down the electric wire 1.

In the fifth and sixth embodiments, the locking portion of the pushing-in member is improved. The same numbers are accorded to parts having the same configuration as in the first embodiment, and an explanation thereof omitted.

Figure 15:
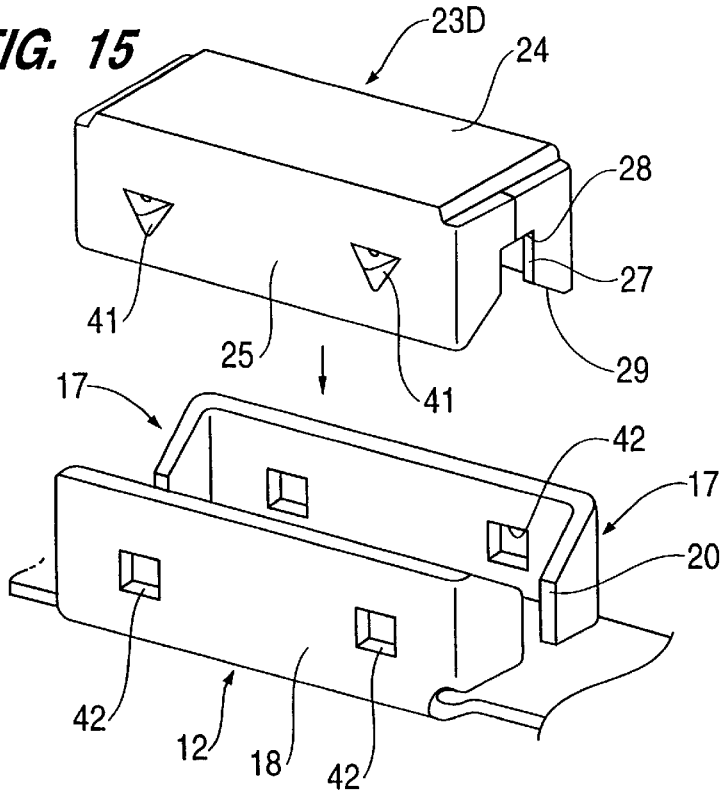
FIG. 15 is a diagonal view showing a locking configuration of a fifth embodiment of the present invention.

FIG. 15 shows a fifth embodiment of the present invention. Left and right side plates 25 of a pushing-in member 23D have a pair each of anteriorly and posteriorly located, triangular-shaped locking protrusions 41 formed by part-shearing. When the pushing-in member 23D is completely inserted locking protrusions 41 fit into angular locking holes 42 in the side plates 18.

Figure 16:
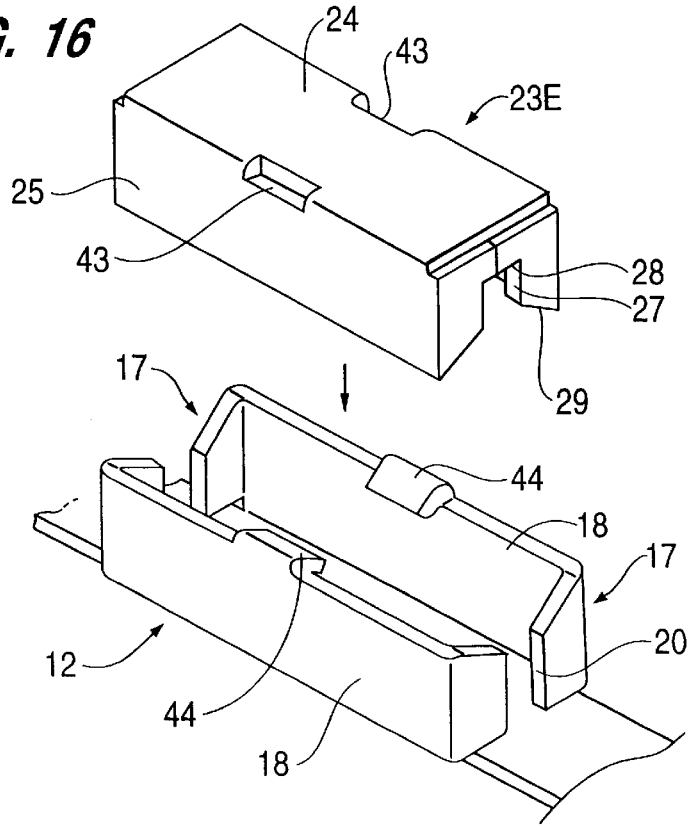
FIG. 16 is a diagonal view showing a locking configuration of a sixth embodiment of the present invention.

FIG. 16 shows a sixth embodiment. The portions constituting the boundaries between a roof face 24 and left and right side plates 25 in a pushing-in member 23E have locking holes 43 cut out therefrom. Left and right side plates 18 of a pressure contact member 12 have locking members 44 that fit into the locking holes 43, these locking members 44 being bent diagonally inwards.

The locking configurations of the fifth and sixth embodiments can also apply in the case where the pushing-in members 23A to 23C of the second to fourth embodiments are employed.

In the seventh and eighth embodiments, the configuration of the portion specifying the amount of insertion of the electric wire is changed. The basic configuration of the pressing-in member itself is the same as that in the first embodiment; the same numbers are accorded to parts having the same configuration, and an explanation thereof omitted.

Figure 18:
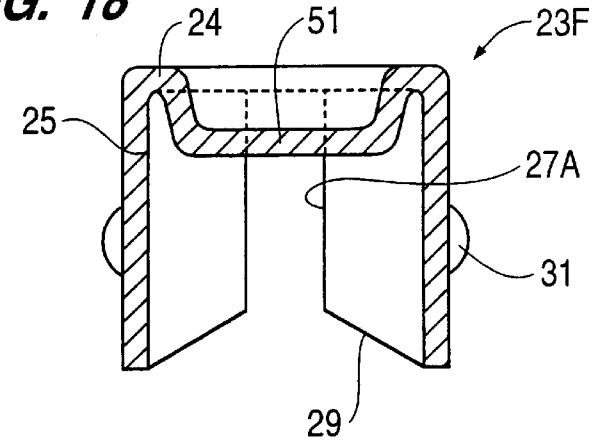
FIG. 18 is a cross-section through the seventh embodiment.
Figure 17:
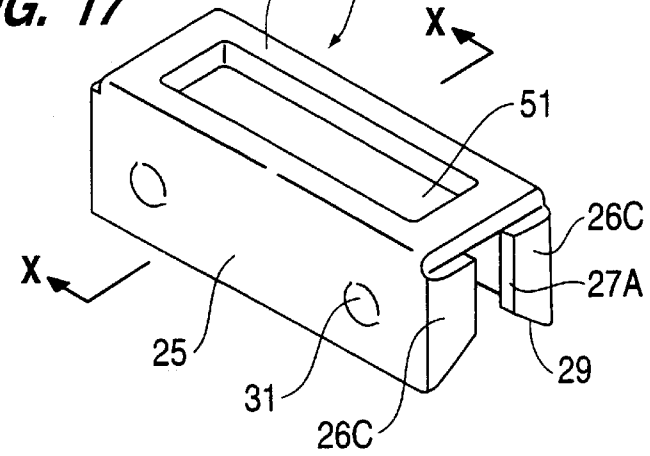
FIG. 17 is a diagonal view of a pushing-in member of a seventh embodiment of the present invention.

FIGS. 17 and 18 show the seventh embodiment. In a pushing-in member 23F, a pressure contact groove 27A, which is formed between end face plates 26C bent so as to face each other, extends up to an upper end, and the central portion of a roof plate 24 is pressed inwards, thereby forming a pressing-down member 51 for the electric wire 1. The amount of pressing down of the electric wire 1 into pressure contact grooves 20 of the pressure contact blades 17 can be set according to the depth of the pressing-down member 51.

Figure 20:
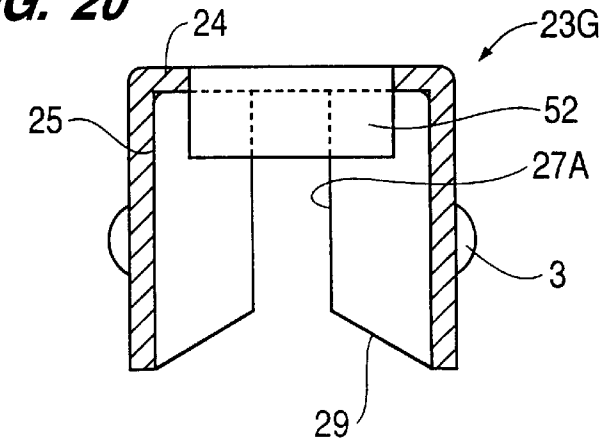
FIG. 20 is a cross-section through the eighth embodiment.
Figure 19:
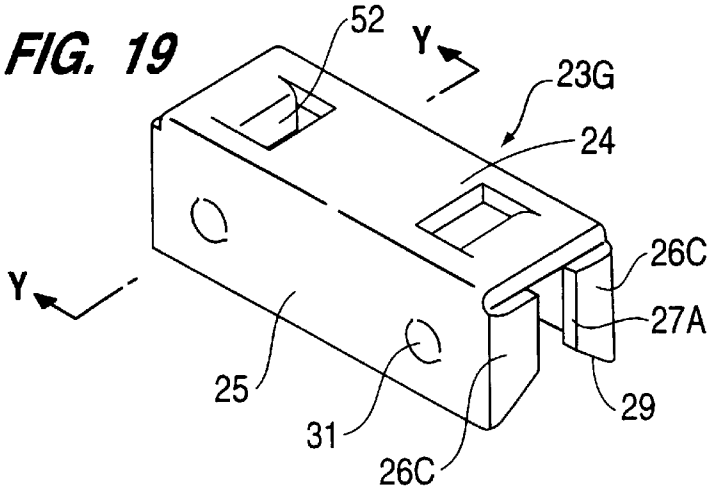
FIG. 19 is a diagonal view of a pushing-in member of an eighth embodiment of the present invention.

FIGS. 19 and 20 show an eighth embodiment of the present invention. In a pushing-in member 23G of the eighth embodiment, a pressure contact groove 27A, formed between end face plates 26C, extends up to the roof face 24. The roof face 24 has a pair of pressing-down members 52 formed by cutting into the roof face 24 at anterior and posterior locations, the pressing-down members 52 serving in use to push in an electric wire 1. The amount of pressing down of the electric wire 1 can be set according to the length of the pressing-down members 52.

The configurations of the seventh and eighth embodiments for setting the amount of pressing down of the electric wire also apply in the case where the pushing-in members 23A to 23C of the second to fourth embodiments are employed.

The present invention is not limited to the embodiments described above with the aid of figures. For example, the possibilities described below also lie within the technical range of the present invention. In addition, the present invention may be embodied in various other ways without deviating from the scope thereof.

(1) In each of the above embodiments, the pushing-in member is made from electrically conductive sheet metal. However, if the focus is on the pushing-in function of the electric wire, the pushing-in member may equally be made of non-electrically conducting sheet metal, or from synthetic resin or the like.

(2) The pushing-in member may equally be arranged to be removable from the pressure contact member after pressure contact with the electric wire. Such an arrangement is also included in the invention.

(3) Although the description is limited to the case where the pushing-in member is made of an electrically conductive sheet metal and is attached to the terminal main body, it may equally be arranged that the terminal main body does not have pressure contact blades but merely houses one end of the electric wire, only the pushing-in member has pressure contact blades formed thereon. In such a case, the electric wire makes electrical contact with the terminal main body via the pushing-in member.

(4) The present invention may equally be applied in the case of a male pressure contact terminal fitting.

(5) In the above embodiments, a case was described wherein the pushing-in member is inserted into the pressure contact member of the terminal main body. However, it may equally be arranged that the pushing-in member covers the external part of the pressure contact member.

(6) Further, in the pushing-in member, a single pressure contact groove can be located between anterior and posterior pressure contact blades of the terminal main body, or can be three in number so as to be located between the anterior and posterior pressure contact blades and on the external sides of the pressure contact blades, and so on.

We claim:

1. A pressure contact terminal fitting comprising a body portion having a base, first and second side walls extending along respective sides of said base, and opposed pressure contact blades to engage an electrical wire, and a pushing-in member for engaging an electrical wire and pushing said wire into engagement with said blades, said pushing-in member including a roof and a pair of downwardly extending side plates, each said side plate extending along a respective side of said roof so as to be coextensive with and received between said side walls, wherein said side plates and roof of said pushing-in member and said base and side walls of said body portion cooperate to enclose a length of the wire when the wire is inserted into the fitting.

2. A fitting according to claim 1 wherein the pushing-in member and body portion have mutually engageable latching means.

3. A fitting according to claim 1 wherein the pushing-in member is of electrically conductive material, and in use is adapted to make electrical contact with said wire.

4. A fitting according to claim 3 wherein said pushing-in member includes opposed pressure contact blades defining a groove for engagement with said electrical wire.

5. A fitting according to claim 1 wherein said body portion and pushing-in member include position setting means adapted to set the pushing-in distance of said wire.

6. A fitting according to claim 5 wherein said position setting means comprises mutually engageable abutment portions of said body portion and pushing-in member.

7. A fitting according to claim 6 wherein said position setting means comprise mutually engageable retaining means of said body portion and pushing-in member.

8. A fitting according to claim 1 wherein said body portion is in the form of a substantially rectangular open box, a short side of which defines said pressure contact blades, and said pushing-in member is in the form of an inverted substantially rectangular open box.

9. A fitting according to claim 8 wherein said pushing-in member is insertable in the opening of said body portion.

10. A fitting according to claim 8 wherein the short sides of said pushing-in member define at least one wire engaging member.

11. A fitting according to claim 8 wherein a wire engaging member is upstanding from the base of said pushing-in member.

12. A fitting according to claim 9 wherein the short sides of said pushing-in member define at least one wire engaging member.

13. A fitting according to claim 9 wherein a wire engaging member is upstanding from the base of said pushing-in member.

14. A pressure contact terminal fitting according to claim 1 wherein said pressure contact blades are positioned transverse to the first and second side walls of said body portion for engaging the electrical wire and positioning the longitudinal axis of the wire along the length of said fitting.

* * * * *